US009409067B2

(12) United States Patent
de la Cruz et al.

(10) Patent No.: US 9,409,067 B2
(45) **Date of Patent: *Aug. 9, 2016**

(54) GOLF CLUB HEAD WITH FLEXURE

(71) Applicant: Acushnet Company, Fairhaven, MA (US)

(72) Inventors: Noah de la Cruz, San Diego, CA (US); Charles E. Golden, Encinitas, CA (US); Stephanie Bezilla, Carlsbad, CA (US); Darryl C. Galvan, El Cajon, CA (US); Mark C. Myrhum, Del Mar, CA (US); Gery M. Zimmerman, Fallbrook, CA (US); Uday V. Deshmukh, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 50 days.

This patent is subject to a terminal disclaimer.

(21) Appl. No.: 14/484,171

(22) Filed: Sep. 11, 2014

(65) Prior Publication Data

US 2014/0378244 A1 Dec. 25, 2014

Related U.S. Application Data

(63) Continuation of application No. 13/618,963, filed on Sep. 14, 2012, now Pat. No. 8,834,289.

(51) Int. Cl.
*A63B 53/04* (2015.01)

(52) U.S. Cl.
CPC ..... *A63B 53/0466* (2013.01); *A63B 60/52* (2015.10); *A63B 2053/042* (2013.01); *A63B 2053/045* (2013.01); *A63B 2053/0408* (2013.01); *A63B 2053/0433* (2013.01); *A63B 2053/0437* (2013.01); *A63B 2053/0458* (2013.01); *A63B 2060/002* (2015.10); *A63B 2209/00* (2013.01); *A63B 2209/02* (2013.01)

(58) Field of Classification Search
CPC ..... A63B 53/0466; A63B 2053/0458; A63B 2053/045; A63B 2059/003; A63B 2209/02; A63B 2053/042; A63B 49/06; A63B 2053/0433; A63B 2053/0437; A63B 2209/00; A63B 2053/0408
USPC ..... 473/324–350, 287–292
See application file for complete search history.

(56) References Cited

U.S. PATENT DOCUMENTS

| | | | |
|---|---|---|---|
| 819,900 | A | 5/1906 | Martin |
| 1,705,997 | A | 3/1929 | Quynn |
| 2,968,486 | A | 1/1961 | Walton |
| 3,084,940 | A | 4/1963 | Cissel |
| 3,166,320 | A | 1/1965 | Onions |

(Continued)

FOREIGN PATENT DOCUMENTS

| | | |
|---|---|---|
| JP | 01259876 | 10/1989 |
| JP | 2002-52099 | 2/2002 |

OTHER PUBLICATIONS

English language translation of JP Patent Publication No. 2002-52099A (full text).

*Primary Examiner* — Sebastiano Passaniti
(74) *Attorney, Agent, or Firm* — Michael J. Mancuso

(57) ABSTRACT

A golf club head including a crown, a sole, a hosel, a face and a flexure. The flexure provides compliance during an impact between the golf club head and a golf ball, and is tuned to vibrate, immediately after impact, at a predetermined frequency.

20 Claims, 8 Drawing Sheets

(56) References Cited

U.S. PATENT DOCUMENTS

| | | | |
|---|---|---|---|
| 4,027,885 | A | 6/1977 | Rogers |
| 4,139,196 | A | 2/1979 | Riley |
| 4,754,974 | A | 7/1988 | Kobayashi |
| 5,076,585 | A | 12/1991 | Bouquet |
| D323,035 | S | 1/1992 | Yang |
| 5,092,599 | A | 3/1992 | Okumoto et al. |
| 5,193,810 | A | 3/1993 | Antonious |
| 5,205,560 | A | 4/1993 | Hoshi et al. |
| 5,221,086 | A | 6/1993 | Antonious |
| 5,346,216 | A | 9/1994 | Aizawa |
| D366,508 | S | 1/1996 | Hutin |
| 5,492,327 | A | 2/1996 | Biafore, Jr. |
| 5,511,786 | A | 4/1996 | Antonious |
| D372,512 | S | 8/1996 | Simmons |
| D375,130 | S | 10/1996 | Hlinka et al. |
| 5,584,770 | A | 12/1996 | Jensen |
| D377,509 | S | 1/1997 | Katayama |
| D378,770 | S | 4/1997 | Hlinka et al. |
| 5,616,088 | A | 4/1997 | Aizawa et al. |
| 5,632,695 | A | 5/1997 | Hlinka |
| D382,612 | S | 8/1997 | Oyer |
| D394,688 | S | 5/1998 | Fox |
| 5,772,527 | A | 6/1998 | Liu |
| D397,750 | S | 9/1998 | Frazetta |
| D403,037 | S | 12/1998 | Stone et al. |
| D405,488 | S | 2/1999 | Burrows |
| D413,952 | S | 9/1999 | Oyer |
| 5,993,329 | A | 11/1999 | Shieh |
| 6,042,486 | A | 3/2000 | Gallagher |
| 6,048,278 | A | 4/2000 | Meyer et al. |
| 6,074,308 | A | 6/2000 | Domas |
| 6,086,485 | A | 7/2000 | Hamada et al. |
| 6,123,627 | A | 9/2000 | Antonious |
| 6,319,149 | B1 | 11/2001 | Lee |
| 6,344,001 | B1 | 2/2002 | Hamada |
| 6,348,013 | B1 | 2/2002 | Kosmatka |
| 6,354,961 | B1 | 3/2002 | Allen |
| 6,368,232 | B1 | 4/2002 | Hamada et al. |
| 6,390,932 | B1 | 5/2002 | Kosmatka et al. |
| 6,506,129 | B2 | 1/2003 | Chen |
| 6,524,194 | B2 | 2/2003 | McCabe |
| 6,530,847 | B1 | 3/2003 | Antonious |
| 6,602,149 | B1 | 8/2003 | Jacobson |
| D482,089 | S | 11/2003 | Burrows |
| D482,090 | S | 11/2003 | Burrows |
| D482,420 | S | 11/2003 | Burrows |
| D484,208 | S | 12/2003 | Burrows |
| 6,663,506 | B2 | 12/2003 | Nishimoto |
| 6,679,786 | B2 | 1/2004 | McCabe |
| D486,542 | S | 2/2004 | Burrows |
| 6,695,715 | B1 | 2/2004 | Chikaraishi |
| 6,719,645 | B2 | 4/2004 | Kouno |
| 6,743,118 | B1 | 6/2004 | Soracco |
| 6,783,465 | B2 | 8/2004 | Matsunaga |
| D501,036 | S | 1/2005 | Burrows |
| D501,523 | S | 2/2005 | Dogan et al. |
| D501,903 | S | 2/2005 | Tanaka |
| 6,855,068 | B2 | 2/2005 | Antonious |
| D504,478 | S | 4/2005 | Burrows |
| 6,887,165 | B2 | 5/2005 | Tsurumaki |
| D506,236 | S | 6/2005 | Evans et al. |
| D508,274 | S | 8/2005 | Burrows |
| 6,979,270 | B1 | 12/2005 | Allen |
| D520,585 | S | 5/2006 | Hasebe |
| D523,104 | S | 6/2006 | Hasebe |
| 7,097,572 | B2 | 8/2006 | Yabu |
| 7,140,974 | B2 | 11/2006 | Chao et al. |
| 7,156,750 | B2 | 1/2007 | Nishitani et al. |
| D536,402 | S | 2/2007 | Kawami |
| 7,211,006 | B2 | 5/2007 | Chang |
| 7,226,366 | B2 | 6/2007 | Galloway |
| 7,241,230 | B2 | 7/2007 | Tsunoda et al. |
| D552,701 | S | 10/2007 | Ruggiero et al. |
| 7,294,064 | B2 | 11/2007 | Tsurumaki et al. |
| 7,318,782 | B2 | 1/2008 | Imamoto et al. |
| 7,344,452 | B2 | 3/2008 | Imamoto et al. |
| 7,347,795 | B2 | 3/2008 | Yamagishi et al. |
| 7,438,649 | B2 | 10/2008 | Ezaki et al. |
| 7,470,201 | B2 | 12/2008 | Nakahara et al. |
| 7,500,924 | B2 | 3/2009 | Yokota et al. |
| 7,530,901 | B2 | 5/2009 | Imamoto et al. |
| 7,530,903 | B2 | 5/2009 | Imamoto et al. |
| 7,572,193 | B2 | 8/2009 | Yokota et al. |
| 7,582,024 | B2 | 9/2009 | Shear |
| 7,585,233 | B2 | 9/2009 | Horacek et al. |
| 7,682,264 | B2 | 3/2010 | Hsu et al. |
| D616,952 | S | 6/2010 | Oldknow |
| 7,857,711 | B2 | 12/2010 | Shear |
| 7,896,753 | B2 | 3/2011 | Boyd et al. |
| 8,235,841 | B2 | 8/2012 | Stites et al. |
| 8,235,844 | B2 | 8/2012 | Albertsen et al. |
| 8,241,143 | B2 | 8/2012 | Albertsen et al. |
| 8,241,144 | B2 | 8/2012 | Albertsen et al. |
| 8,403,771 | B1 | 3/2013 | Rice et al. |
| 8,529,368 | B2 | 9/2013 | Rice et al. |
| 8,641,555 | B2 | 2/2014 | Stites et al. |
| 8,834,289 | B2 * | 9/2014 | de la Cruz ..... A63B 53/0466 473/329 |
| 2002/0055396 | A1 | 5/2002 | Nishimoto |
| 2002/0183134 | A1 | 12/2002 | Allen |
| 2003/0220154 | A1 | 11/2003 | Anelli |
| 2004/0176183 | A1 | 9/2004 | Tsurumaki |
| 2004/0192463 | A1 | 9/2004 | Tsurumaki |
| 2005/0049081 | A1 | 3/2005 | Boone |
| 2006/0052177 | A1 | 3/2006 | Nakahara et al. |
| 2007/0026961 | A1 | 2/2007 | Hou |
| 2007/0082751 | A1 | 4/2007 | Lo |
| 2012/0142447 | A1 | 6/2012 | Boyd et al. |
| 2012/0196701 | A1 | 8/2012 | Stites |
| 2012/0244960 | A1 | 9/2012 | Tang et al. |
| 2012/0270676 | A1 | 10/2012 | Burnett |
| 2012/0277029 | A1 | 11/2012 | Albertsen |
| 2012/0277030 | A1 | 11/2012 | Albertsen |

* cited by examiner

GOLF CLUB HEAD WITH FLEXURE

CROSS-REFERENCE TO RELATED APPLICATIONS

This application is a continuation of U.S. patent application Ser. No. 13/618,963, filed on Sep. 14, 2012, which is currently pending, the disclosure of which is hereby incorporated by reference in its entirety.

FIELD OF THE INVENTION

The present invention relates to an improved golf club head. More particularly, the present invention relates to a golf club head having a compliant portion adjacent to its face.

BACKGROUND

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity, inertia, material selection, and overall head weight. While this basic set of criteria is generally the focus of golf club engineering, several other design aspects must also be addressed. The interior design of the club head may be tailored to achieve particular characteristics, such as the inclusion of hosel or shaft attachment means, perimeter weights on the club head, and fillers within hollow club heads.

Golf club heads must also be strong to withstand the repeated impacts that occur during collisions between the golf club and the golf ball. The loading that occurs during this transient event can create a peak force of over 2,000 lbs. Thus, a major challenge is designing the club face and body to resist permanent deformation or failure by material yield or fracture. Conventional hollow metal wood drivers made from titanium typically have a face thickness exceeding 2.5 mm to ensure structural integrity of the club head.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

The United States Golf Association (USGA), the governing body for the rules of golf in the United States, has specifications for the performance of golf balls. These performance specifications dictate the size and weight of a conforming golf ball. One USGA rule limits the golf ball's initial velocity after a prescribed impact to 250 feet per second+2% (or 255 feet per second maximum initial velocity). To achieve greater golf ball travel distance, ball velocity after impact and the coefficient of restitution of the ball-club impact must be maximized while remaining within this rule.

Generally, golf ball travel distance is a function of the total kinetic energy imparted to the ball during impact with the club head, neglecting environmental effects. During impact, kinetic energy is transferred from the club and stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and in viscoelastic relaxation of the ball. Viscoelastic relaxation is a material property of the polymeric materials used in all manufactured golf balls.

Viscoelastic relaxation of the ball is a parasitic energy source, which is dependent upon the rate of deformation. To minimize this effect, the rate of deformation must be reduced. This may be accomplished by allowing more club face deformation during impact. Since metallic deformation may be purely elastic, the strain energy stored in the club face is returned to the ball after impact thereby increasing the ball's outbound velocity after impact.

A variety of techniques may be utilized to vary the deformation of the club face, including uniform face thinning, thinned faces with ribbed stiffeners and varying thickness, among others. These designs should have sufficient structural integrity to withstand repeated impacts without permanently deforming the club face. In general, conventional club heads also exhibit wide variations in initial ball speed after impact, depending on the impact location on the face of the club. Hence, there remains a need in the art for a club head that has a larger "sweet zone" or zone of substantially uniform high initial ball speed.

Technological breakthroughs in recent years provide the average golfer with more distance, such as making larger head clubs while keeping the weight constant or even lighter, by casting consistently thinner shell thickness and going to lighter materials such as titanium. Also, the faces of clubs have been steadily becoming extremely thin. The thinner face maximizes the coefficient of restitution (COR). The more a face rebounds upon impact, the more energy that may be imparted to the ball, thereby increasing distance. In order to make the faces thinner, manufacturers have moved to forged, stamped or machined metal faces which are generally stronger than cast faces. Common practice is to attach the forged or stamped metal face by welding them to the body or sole. The thinner faces are more vulnerable to failure. The present invention provides a novel manner for providing the face of the club with the desired flex and rebound at impact thereby maximizing COR.

SUMMARY OF THE INVENTION

The present invention relates to a golf club head including a flexure that alters the compliance characteristics as compared to known golf club heads.

In an embodiment, a golf club head includes a crown, a sole, a side wall, a hosel, a face and a flexure. The crown defines an upper surface of the golf club head, the sole defines a lower surface of the golf club head, and the side wall extends between the crown and sole. The hosel extends from the crown and includes a shaft bore. The face defines a ball-striking surface and intersects the lower surface at a leading edge. The flexure is elongate and recessed into the sole, extending in a generally heel-to-toe direction and parallel to the leading edge of the golf club head, and intersecting the side wall of the golf club head. The flexure is defined by a first portion and a second portion that join at an apex to form a generally sharktooth cross-sectional shape. The height of the flexure is between about 5.0 mm and 15.0 mm, and the width of the flexure across the recess at the lower surface, is between about 5.0 mm and about 12.0 mm, and the flexure is tuned so that the width across the flexure in a face-to-aft direction varies sinusoidally, immediately after impact, at a frequency of about 2900 Hz to about 4000 Hz.

In another embodiment, the golf club head includes a crown, a sole, a side wall, a hosel, a face and a flexure. The crown defines an upper surface of the golf club head, the sole defines a lower surface of the golf club head, and the side wall extends between the crown and sole. The hosel extends from the crown and includes a shaft bore. The face defines a ball-striking surface and intersects the lower surface at a leading edge, and a perimeter of the face is coupled to the crown and the sole. The flexure is elongate and recessed into the sole, and defined by a first portion and a second portion. The length of the first portion is different than the length of the second portion so that the flexure has a generally sharktooth cross-sectional shape. The first portion extends from the sole toward the interior of the golf club head and the second portion extends from the sole toward the interior of the golf club head, and the first portion interfaces the second portion at an apex. The flexure extends across the body in a generally heel-to-toe direction within about 5.0 mm and about 20.0 mm from the leading edge of the golf club head and intersects at least a portion of the side wall of the golf club head.

In a further embodiment, a golf club head includes a crown, a sole, a side wall, a hosel, a face and a flexure. The crown defines an upper surface of the golf club head, the sole defines a lower surface of the golf club head, and the side wall extends between the crown and sole. The hosel extends from the crown and includes a shaft bore. The face defines a ball-striking surface and intersecting the lower surface at a leading edge, wherein a perimeter of the face is coupled to the crown and the sole. The flexure is elongate and recessed into the sole and defined by a first portion and a second portion. The length of the first portion is different than the length of the second portion so that the flexure has a generally sharktooth cross-sectional shape. The first portion extends from the sole toward the interior of the golf club head and the second portion extends from the sole toward the interior of the golf club head, and the first portion interfaces the second portion at an apex. A cover that extends across a width of the elongate flexure across the recess. The flexure extends across the body in a generally heel-to-toe direction within about 5.0 and about 20.0 mm from the leading edge of the golf club head and intersects at least a portion of the side wall of the golf club head.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
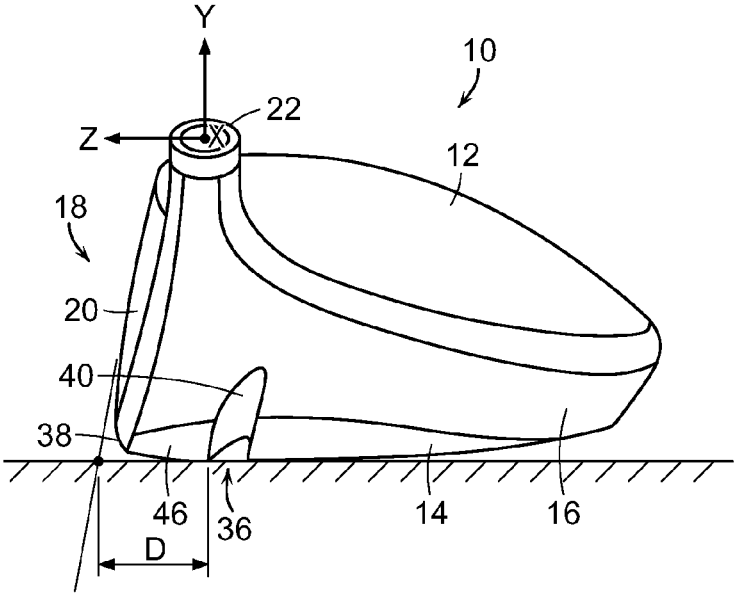
FIG. 1 is a side view of an embodiment of a club head of the present invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Coefficient of restitution, or "COR", is a measure of collision efficiency. COR is the ratio of the velocity of separation to the velocity of approach. As an example, such as for a golf ball struck off of a golf tee, COR may be determined using the following formula:

$$(M_{ball}(V_{ball\text{-}post}-V_{ball\text{-}pre})+M_{club}(V_{ball\text{-}post}-V_{club\text{-}pre}))/M_{club}(V_{club\text{-}pre}-V_{ball\text{-}pre})$$

where, $V_{club\text{-}post}$ represents the velocity of the club after impact;

$V_{ball\text{-}post}$ represents the velocity of the ball after impact;

$V_{club\text{-}pre}$ represents the velocity of the club before impact (a value of zero for USGA COR conditions); and $V_{ball\text{-}pre}$ represents the velocity of the ball before impact.

Because the initial velocity of the ball is 0.0 during the collision, because it is stationary on a golf tee, the formula reduces to the following:

$$(M_{ball}V_{ball\text{-}post}+M_{club}(V_{ball\text{-}post}-V_{club\text{-}pre}))/M_{club}(V_{club\text{-}pre})$$

COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, high COR values are indicative of greater ball velocity and distance.

Referring to FIGS. 1-4, an embodiment of a golf club head 10 of the present invention is shown. Club head 10 includes a construction that improves behavior of the club when struck by a golf ball, particularly when a lower portion of the face is struck. Club head 10 is a hollow body that includes a crown 12, a sole 14, a skirt 16, or side wall, that extends between crown 12 and sole 14, a face 18 that provides a ball striking surface 20, and a hosel 22. It should be understood that skirt 16 may comprise perimeter portions of crown 12 and sole 14 that curve towards each other to form the transition between an upper surface and a lower surface of the golf club head. The hollow body defines an inner cavity 24 that may be left empty or may be partially filled. If it is filled, it is preferable that inner cavity 24 be filled with foam or another low specific gravity material.

When club head 10 is in the address position, crown 12 provides an upper surface and sole 14 provides a lower surface of the golf club head. Skirt 16 extends between crown 12 and sole 14 and forms a perimeter of the club head. Face 18 provides a forward-most ball-striking surface 20 and includes a perimeter that is coupled to crown 12, sole 14 and skirt 16 to enclose cavity 24. Face 18 includes a toe portion 26 and a heel portion 28 on opposite sides of a geometric center of face 18. Hosel 22 extends outward from crown 12 and skirt 16 adjacent heel portion 28 of face 18 and provides an attachment structure for a golf club shaft (not shown).

Figure 2:
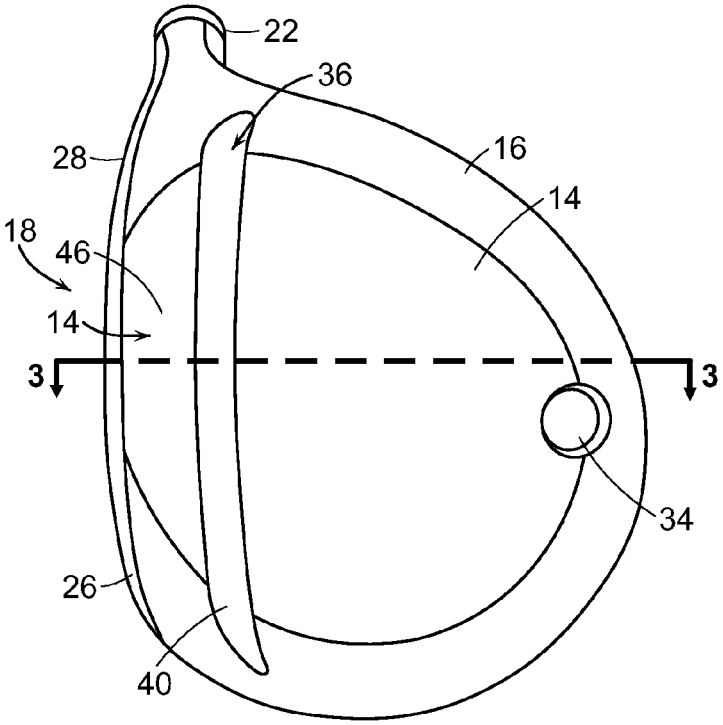
FIG. 2 is bottom plan view of an embodiment of a club head of FIG. 1.
Figure 3:
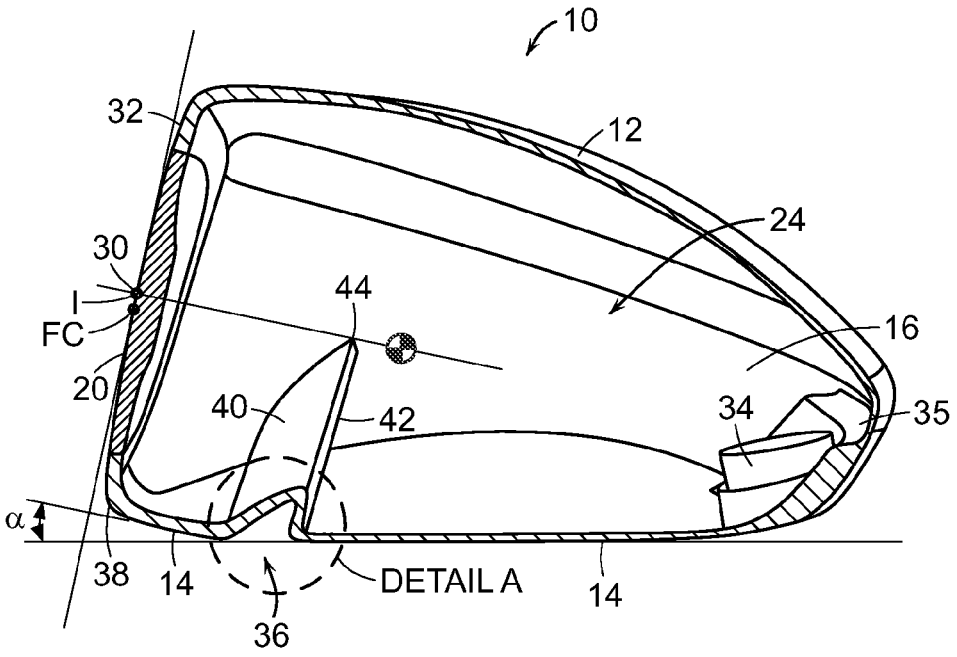
FIG. 3 is a cross-sectional view, corresponding to line 3-3 of FIG. 2.

Hosel 22 may have a through-bore or a blind hosel construction. In particular, hosel 22 is generally a tubular member and it may extend through cavity 24 from crown 12 to the bottom of the club head 10 at sole 14 or it may terminate at a location between crown 12 and sole 14. Furthermore, a proximal end of hosel 22 may terminate flush with crown 12, rather than extending outward from the club head away from crown 12 as shown in FIGS. 1 and 2.

Inner cavity 24 may have any volume, but is preferably greater than 100 cubic centimeters, and the golf club head may have a hybrid, fairway or driver type constructions. Preferably, the mass of the inventive club head 10 is greater than about 150 grams, but less than about 220 grams, although the club head may have any suitable weight for a given length to provide a desired overall weight and swing weight. The body may be formed of stamped, forged, cast and/or molded components that are welded, brazed and/or adhered together. Golf club head 10 may be constructed from a titanium alloy, any other suitable material or combinations of different materials. Further, weight members constructed of high density mater, such as tungsten, may be coupled to any portion of the golf club head, such as the sole.

Face 18 may include a face insert 30 that is coupled to a face perimeter 32, such as a face flange. The face perimeter 32 defines an opening for receiving the face insert 30. The face insert 30 is preferably connected to the perimeter 32 by welding. For example, a plurality of chads or tabs (not shown) may be provided to form supports for locating the face insert 30 or a face insert may be tack welded into position, and then the face insert 30 and perimeter 32 may be integrally connected by laser or plasma welding. The face insert 30 may be made by milling, casting, forging or stamping and forming from any suitable material, such as, for example, titanium, titanium alloy, carbon steel, stainless steel, beryllium copper, and carbon fiber composites and combinations thereof. Additionally, crown 12 or sole 14 may be formed separately and coupled to the remainder of the body.

The thickness of the face insert 30 is preferably between about 0.5 mm and about 4.0 mm. Additionally, the insert 30 may be of a uniform thickness or a variable thickness. For example, the face insert 30 may have a thicker center section and thinner outer section. In another embodiment, the face insert 30 may have two or more different thicknesses and the transition between thicknesses may be radiused or stepped. Alternatively, the face insert 30 may increase or decrease in thickness towards toe portion 26, heel portion 28, crown 12 and/or sole 14. It will be appreciated that one or both of the ball-striking surface or the rear surface of face 18 may have at least a portion that is curved, stepped or flat to vary the thickness of the face insert 30.

As mentioned above, club head 10 includes a construction that improves behavior of the club when it strikes a golf ball, particularly when a lower portion of the face impacts a golf ball. A flexure 36 is formed in a forward portion of the crown, sole and/or skirt. Flexure 36 is an elongate corrugation that extends in a generally heel to toe direction and that is formed in a forward portion of sole 14.

Flexure 36 is generally flexible in a fore/aft direction and provides a flexible portion in the club head 10 away from face 18 so that it allows at least a portion of face 18 to translate and rotate as a unit, in addition to flexing locally, when face 18 impacts a golf ball. The golf club head is designed to have two distinct vibration modes of the face between about 3000 Hz and about 6000 Hz, and the flexure is generally constructed to add the second distinct vibration mode of the face. The first face vibration mode primarily includes the local deflection of the face during center face impacts with a golf ball. The deflection profile of the second face vibration mode generally includes the entire face deflecting similar to an accordion and provides improved performance for off-center impacts between the face and a golf ball.

Flexure 36 is also configured to generally maintain the stiffness of sole 14 in a crown/sole direction so that the sound of the golf club head is not significantly affected. A lower stiffness of the sole in the crown/sole direction will generally lower the pitch of the sound that the club head produces, and the lower pitch is generally undesirable.

Flexure 36 allows the front portion of the club, including face 18, to flex differently than would otherwise be possible without altering the size and/or shape of face 18. In particular, a portion of the golf club head body adjacent the face is designed to elastically flex during impact. That flexibility reduces the reduction in ball speed, and reduces the backspin, that would otherwise be experienced for ball impacts located below the ideal impact location. The ideal impact location is a location on the ball-striking surface that intersects an axis that is normal to the ball-striking surface and that extends through the center of gravity of the golf club head, and as a result the ideal impact location is generally located above the geometric face center by a distance between about 0.5 mm and 5.0 mm. By providing flexure 36 in sole 14, close to face 18, the club head provides less of a reduction in ball speed, and lower back spin, when face 18 impacts a golf ball at a location below the ideal impact location. Thus, ball impacts at the ideal impact location and lower on the club face of the inventive club head will go farther than the same impact location on a conventional club head for the same swing characteristics. Locating flexure 36 in sole 14 is especially beneficial because the ideal impact location is generally located higher than the geometric face center in metal wood-type golf clubs. Therefore, a large portion of the face area is generally located below the ideal impact location. Additionally, there is a general tendency of golfers to experience golf ball impacts low on the face. Similar results, however, may be found for a club head 10 with flexures provided on other portions of the club head 10 for impacts located toward the flexure from the geometric face center. For example, a club having a flexure disposed in the crown may improve performance for ball impacts that are between the crown and the geometric face center.

In an embodiment, flexure 36 is provided such that it is substantially parallel to at least a portion of a leading edge 38 of the club head 10, so that it is generally curved with the leading edge, and is provided within a selected distance D from ball-striking surface 20. Preferably, flexure 36 is provided a distance D within 30 mm of ball-striking surface 20, more preferably within 20 mm of ball-striking surface 20, and more preferably between about 5.0 mm and 20.0 mm. For smaller golf club heads, such as those with fairway wood or hybrid constructions, it is preferable that the flexure 36 is provided within 10 mm of ball striking surface 20.

Flexure 36 is constructed from a first member 40 and a second member 42. First member 40 is coupled to a rearward edge of a forward transmittal portion 46 of sole 14 and curves into inner cavity 24 from sole 14. Second member 42 is coupled to a forward edge of a rearward portion of sole 14 and also curves into inner cavity 24 from sole 14. The ends of first member 40 and second member 42 that are spaced away from sole 14 are coupled to each other at an apex 44. Preferably, the flexure is elongate and extends in a generally heel to toe direction.

Figure 4:
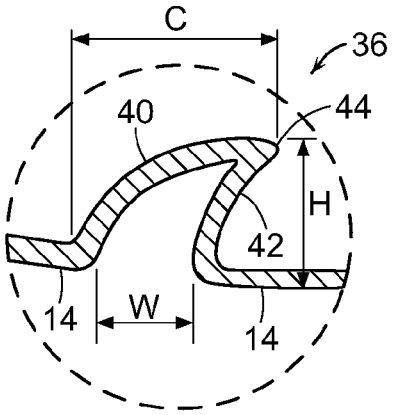
FIG. 4 is a cross-sectional view of a portion, shown in FIG. 3 as detail A, of the golf club head of FIG. 1.

The dimensions of flexure 36 are selected to provide a desired flexibility during a ball impact. Flexure 36 has a height H, a width W, and a curl length C, as shown in FIG. 4. Height H extends in the direction of the Y-axis between apex 44 and an outer surface of sole 14. Width W is the width of an opening in the sole that is created by flexure 36 and extends in the direction of the Z-axis between the junctions of flexure 36 with sole 14. Curl length C extends in the direction of the Z-axis and extends between the forward junction of flexure 36 with sole 14 and apex 44. Preferably, flexure 36 has a height that is greater than 4.0 mm, preferably about 5.0 mm to about 15.0 mm, more preferably about 6.0 mm to about 11.0 mm. Further, flexure 36 preferably has a width that is greater than 4.0 mm, preferably about 5.0 mm to about 12.0 mm, more preferably about 7.0 to about 11.0 mm. The flexure also has a wall thickness between about 0.8 mm and about 2.0 mm, and those dimensions preferably extend over a length that is at least 25% of the overall club head length along the X-axis. Further, first member 40 is curved inward, into the inner cavity, from the sole and preferably has a radius of curvature between about 20.0 mm and about 45.0 mm. Table 1, below, illustrates dimensions for inventive examples that provide a more efficient energy transfer, and therefore higher COR, for ball impacts that are below the ideal impact location of the golf club head.

TABLE 1

| Flexure Dimensions | | | |
|---|---|---|---|
| | Height [mm] | Width [mm] | Curl Length [mm] |
| Inv. Example 1 | 10.0 | 10 | 13 |
| Inv. Example 2 | 6.5 | 10 | 13 |
| Inv. Example 3 | 10.0 | 8 | 13 |
| Inv. Example 4 | 6.5 | 8 | 13 |
| Inv. Example 5 | 5.0 | 8 | 13 |

The inventive examples described above were analyzed using finite element analysis to determine the effect on COR and vibration response of the golf club head. In particular, a club head lacking a flexure (i.e., Baseline) was compared to the inventive examples. Table 2 summarizes the comparison.

TABLE 2

| Comparison | | | | | | |
|---|---|---|---|---|---|---|
| | Weight Penalty [g] | Ball Speed [mph] | Extra Mode [Hz] | Mode 2 [Hz] | Mode 3 [Hz] | Mode 4 [Hz] |
| Baseline | N/A | 160.67 | N/A | 3409 | 3538 | 3928 |
| Inv. Example 1 | 7.0 | 157.16 | 2157 | 3608 | 3767 | 3907 |
| Inv. Example 2 | 5.4 | 161.28 | 3196 | 3639 | 3840 | 4002 |
| Inv. Example 3 | 7.6 | No data | 2186 | 3559 | 3706 | 3895 |
| Inv. Example 4 | 5.6 | 161.28 | 3406 | 3603 | 3796 | 4019 |
| Inv. Example 5 | 4.1 | 160.87 | N/A | 3540 | 3675 | 4163 |

In the above table, "extra mode" refers to a mode shape, or a natural mode of vibration that does not exist unless a flexure is present. The extra mode generally presents itself as a the face portion rotating and flexing relative to the remainder of the golf club body. In particular, the inventive examples include a flexure that extends across a portion of the sole and the extra mode includes the face rotating about the interface between the face and crown so that the flexure flexes. The flexure is tuned so that that extra mode takes place in a range of frequencies from about 2900 Hz to about 4000 Hz, and more preferably at approximately 3600 Hz, which has been analyzed to be most effective in increasing the ball speed after impact. Practically speaking, that tuning results in the width W of the flexure varying sinusoidally, immediately after impact, at a frequency of about 2900 Hz to about 4000 Hz. If the extra mode takes place at a frequency that is higher or lower than that range, the ball speed can actually be lower compared to the baseline example that does not include a flexure. It has been determined using FEA analysis of inventive example 1 that a flexure that is tuned to provide an extra mode with a frequency below 2900 Hz, particularly approximately 2157 Hz, the ball speed is reduced below the baseline golf club head that does not include a flexure. Additionally, including a flexure that is too rigid provides a golf club head that does not include the extra mode, as shown by inventive example 5, and only provides minimal increase in ball speed after impact.

Transmittal portion 46 of sole 14 extends between flexure 36 and leading edge 38. Transmittal portion 46 is preferably constructed so that the force of a golf ball impact is transmitted to flexure 18 without transmittal portion 46 flexing significantly. For example, transmittal portion is oriented so that it is less inclined to bend. In particular, a transmittal plane that is tangent to the center of transmittal portion 46 (in both fore/aft and heel/toe directions) of sole 14 is angled relative to the ground plane by an angle $\alpha$. Angle $\alpha$ is preferably less than, or equal to, the loft angle of the golf club head at address, so that the angle between the transmittal plane and the ball striking surface is generally equal to, or less than, 90° so that transmittal portion 46 is less likely to bend during a ball impact.

Flexure 36 may be formed by any suitable manner. For example, flexure 36 may be cast as an integral part of sole 14. Alternatively, flexure 36 may be stamped or forged into a sole component. Additionally, the flexure may be formed by including a thickened region and machining a recess in that thickened region to form the flexure. For example, a spin-milling process may be used to provide a desired recess, the spin-milling process is generally described in U.S. Pat. No. 8,240,021 issued Aug. 14, 2012 as applied to face grooves, but a flexure with a desired profile may be machined using that process by increasing the size of the spin mill tool and altering the profile of the cutter. In general, that process utilizes a tool having an axis of rotation that is parallel to the sole and perpendicular to the leading edge of the golf club head and a cutting end that is profiled to create the desired profile of the flexure. The tool is then moved along a cutting path that is generally parallel to the leading edge. As a further alternative described in greater detail below, a separate flexure component may be added to a flexure on the sole to further tune the flexure of the sole, as shown in FIGS. 5 and 6.

Figure 12:
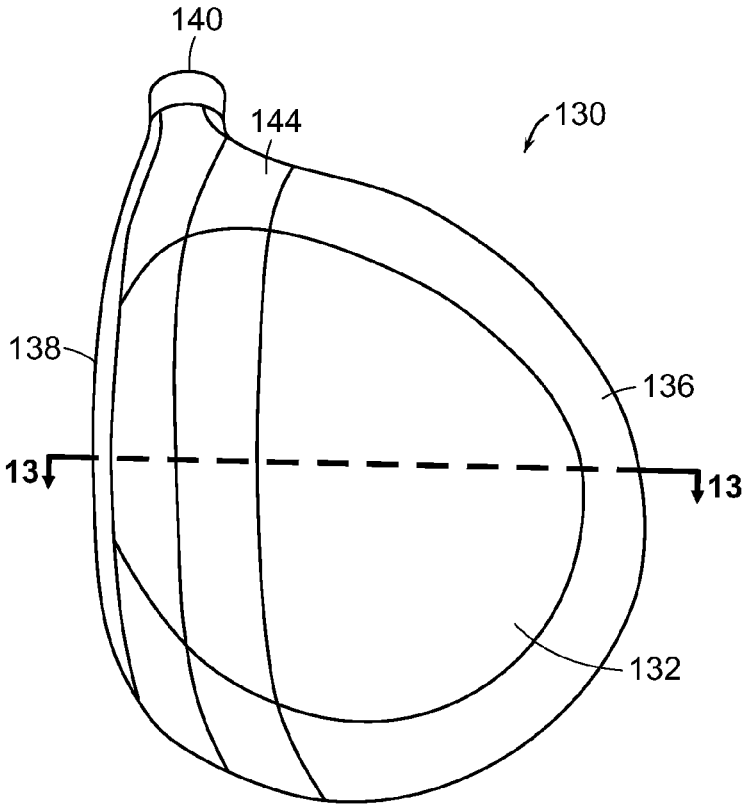
FIG. 12 is a bottom plan view of the golf club head of FIG. 11.

As shown in the embodiment of FIG. 1, the face of the golf club head may include a face insert that is stamped, forged and/or machined separately and coupled to the body of the golf club head. Alternatively, the entire face may be stamped, forged or cast as part of a homogeneous shell, as shown in FIGS. 5 and 6, thereby eliminating the need to bond or otherwise permanently secure a separate face insert to the body. As a still further alternative, the face may be part of a stamped or forged face component, such as a face cup, that includes portions of the sole, crown and/or skirt, as shown in FIG. 12. In such an embodiment, the face component is coupled to the remainder of the club head body away from the face plane by a distance from about 0.2 inches to about 1.5 inches. Preferably, the face component includes a transmittal portion of the sole that extends to a flexure or the face component includes both the transmittal portion and the flexure.

Figure 5:
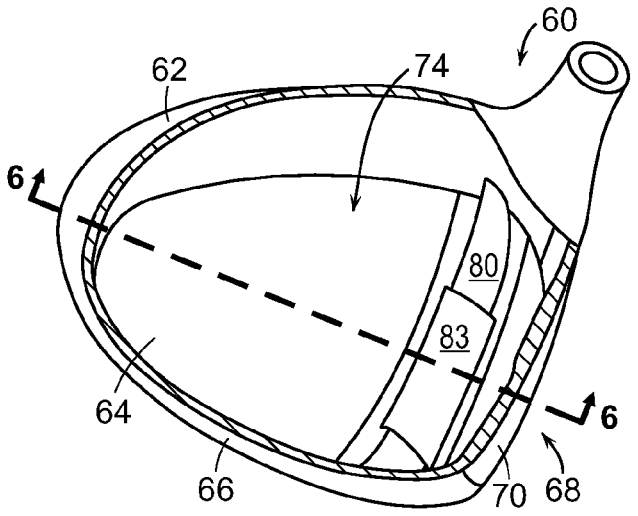
FIG. 5 is a perspective view of a portion of another embodiment of a club head of the present invention.
Figure 6:
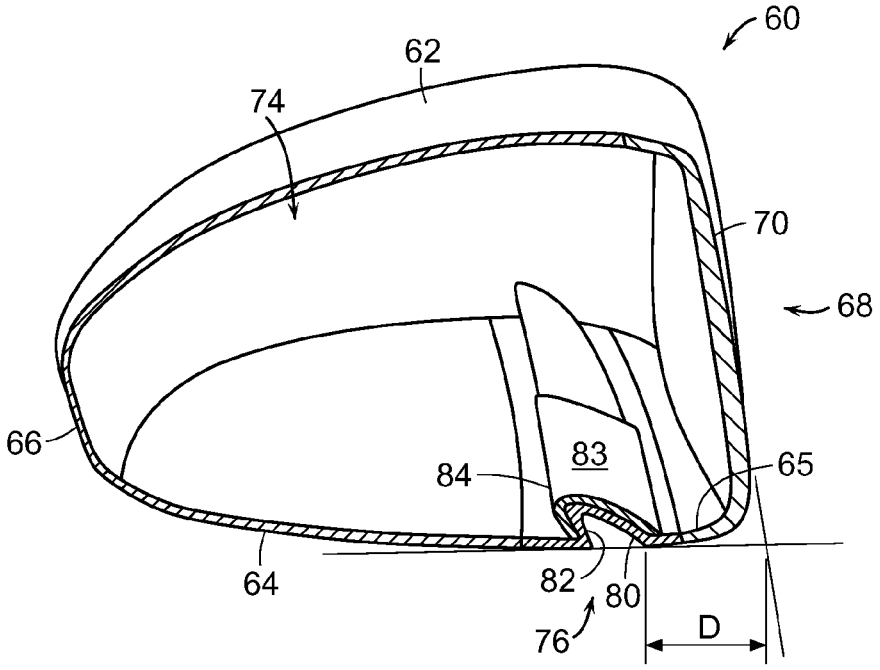
FIG. 6 is a cross-sectional view, corresponding to line 6-6 of FIG. 5.

In another embodiment, illustrated in FIGS. 5 and 6, a golf club head 60 is a hollow body that includes a crown 62, a sole 64, a skirt 66 that extends between crown 62 and sole 64, a face 68 that provides a ball striking surface 70, and a hosel 69. The hollow body defines an inner cavity 74 that may be left empty or it may be fully or partially filled.

A flexure 76 is formed in a forward portion of the sole, but it may alternatively be formed in the crown and/or skirt. Preferably, flexure 76 is an elongate corrugation that extends in a generally heel to toe direction and is formed in a forward portion of sole 64 of the body of golf club head 60. Flexure 76 provides a flexible portion in the club head 60 rearward from face 68 so that it allows at least a portion of face 68 to translate or rotate as a unit, in addition to flexing locally, when face 68 impacts a golf ball.

Flexure 76 allows the front portion of the club, including face 68, to flex differently than would otherwise be possible without altering the size and/or shape of face 68. That flexibility provides less reduction in ball speed that would otherwise be experienced for mis-hits, i.e., ball impacts located away from the ideal impact location, and less spin for impacts below the ideal impact location. For example, by providing flexure 76 in sole 64, close to face 68, the club head provides less of a reduction in ball speed when ball impact is located below the ideal impact location. Thus, during use, ball impacts that occur lower on the club face of the inventive club head will go farther than when compared with the same impact location on a club face of a conventional club head, for common swing characteristics.

In an embodiment, flexure 76 is provided such that it is substantially parallel to at least a portion of a leading edge 78 of the club head 60 and is provided within a certain distance D from ball-striking surface 70. Preferably, flexure 76 is provided a distance D within 30 mm of ball-striking surface 70, more preferably within 20 mm of ball-striking surface 70, and most preferably within 10 mm.

In the present embodiment, flexure 76 is constructed from a first member 80, a second member 82 and a third member 83 and is generally constructed as a separate component that is coupled to sole 64. First member 80 is coupled to a rearward edge of a forward transmittal portion 65 of sole 64 and curves into inner cavity 74 from the transmittal portion 65. Second member 82 is coupled to a forward edge of a rearward portion of sole 64 and also curves into inner cavity 74 from sole 64. The ends of first member 80 and second member 82 that are spaced away from sole 64 are coupled to each other at an apex 84. Preferably, the flexure is elongate and extends in a generally heel to toe direction.

Similar to previous embodiments, the dimensions of flexure 76 are selected to provide a desired elastic flex in response to a ball impact. Flexure 76 defines a height H, a width W, and a curl length C. Preferably, flexure 76 has a height that is greater than 4 mm, preferably about 5 mm to about 15 mm, and a width that is greater than 4 mm, preferably about 5 mm to about 10 mm, and a wall thickness between about 0.8 mm and about 2.0 mm, and those dimensions preferably extend over a length that is at least 25% of the overall club head length along the X-axis.

Flexure 76 includes third member 83 that may be used to tune the flexibility of flexure 76. Third member 83 may be coupled to an inner surface (as shown) or an outer surface of flexure 76 and locally increases the rigidity of flexure 76. Third member 83 is preferably constructed from a material that has a lower specific gravity than the material of at least one of first member 80 and second member 82. Third member 83 may be bonded, such as by using an adhesive, or mechanically coupled, such as by fasteners, welding or brazing, to first member 80 and second member 82. The third member may be constructed from any metallic, such as aluminum, or non-metallic material, such as a carbon fiber composite material or polyurethane.

Figure 7:
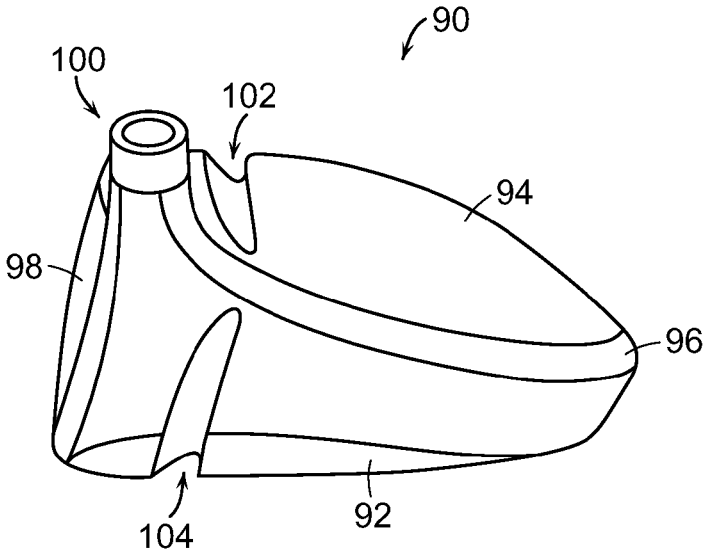
FIG. 7 is a side view of another embodiment of a golf club head of the present invention.
Figure 8:
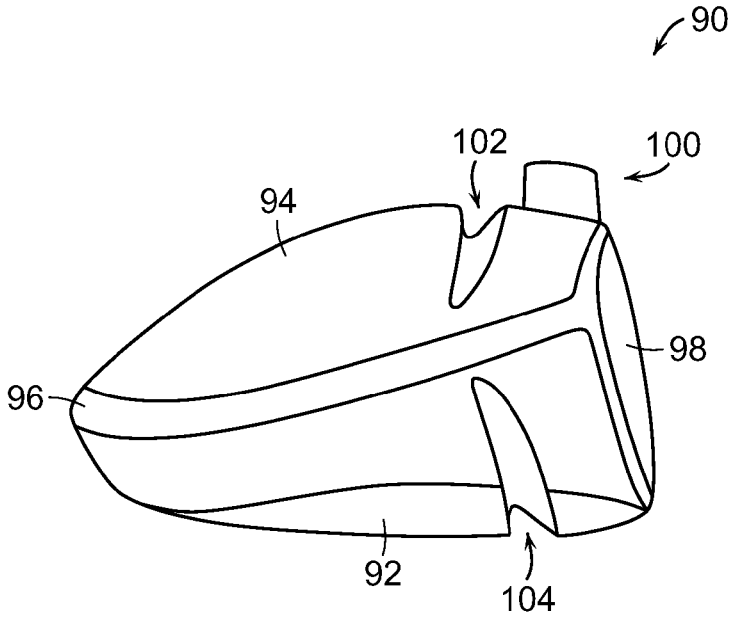
FIG. 8 is a another side view of the golf club head of FIG. 7.

The location, dimensions and number of flexures in a golf club head may be selected to provide desired behavior. For example, a plurality of flexures may be included as shown in golf club head 90 of FIGS. 7 and 8. Golf club head 90 has a hollow body construction generally defined by a sole 92, a crown 94, a skirt 96, a face 98, and a hosel 100. A crown flexure 102 is disposed in a forward portion of crown 94 and a sole flexure 104 is disposed in a forward portion of sole 92. Each of the flexures 102, 104 is preferably shaped and dimensioned as the previously described flexures.

Figure 9:
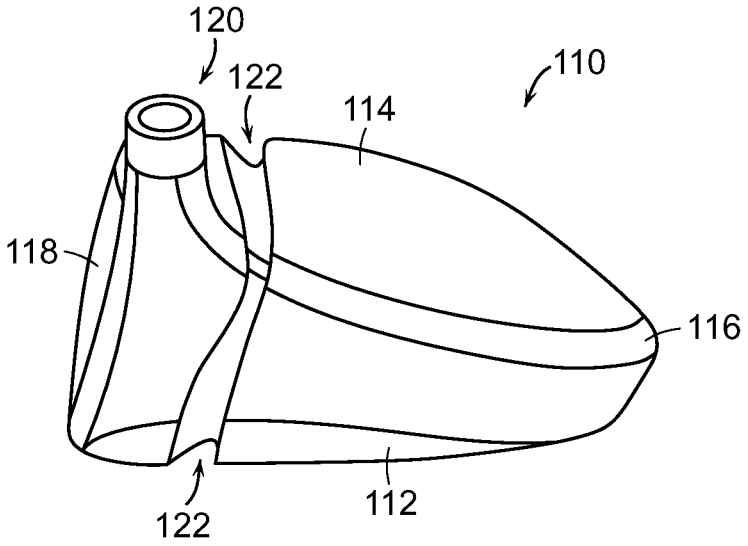
FIG. 9 is a side view of another embodiment of a golf club head of the present invention.
Figure 10:
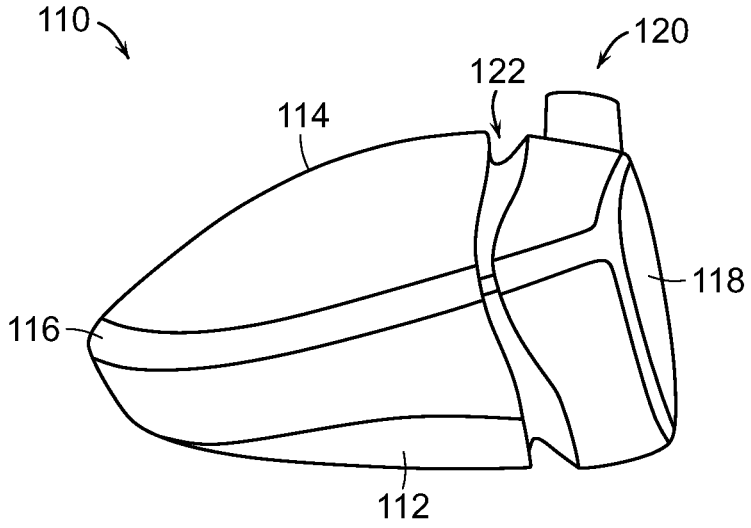
FIG. 10 is a another side view of the golf club head of FIG. 9.

In other embodiments, flexures may be included that wrap around a portion of the golf club head body or entirely around the golf club head body. As shown in FIGS. 9 and 10, a golf club head 110 has a hollow body construction that is defined by a sole 112, a crown 114, a skirt 116, a face 118 and a hosel 120. A flexure 122 is formed in a forward portion of the golf club head and wraps around the perimeter of the golf club head. Flexure 122 is generally formed in a plane that is parallel to a face plane of golf club head 110. The distance between flexure 122 and face 118 may vary along its length to tune the local effect that flexure 122 provides to flexibility of the golf club head. For example, portions of flexure 122 may be spaced further from face 118 as compared to other portions. As illustrated, in an embodiment, heel and toe portions of flexure 122 are spaced further from face 118 than sole and crown portions of flexure 122. Additionally, the dimensions of flexure 122 may also be altered to tune the local effect that flexure 122 provides to the flexibility of the golf club head. As illustrated, portions of flexure 122 may have different height, width, and/or curl length to alter the behavior of the portions of flexure 122.

Figure 11:
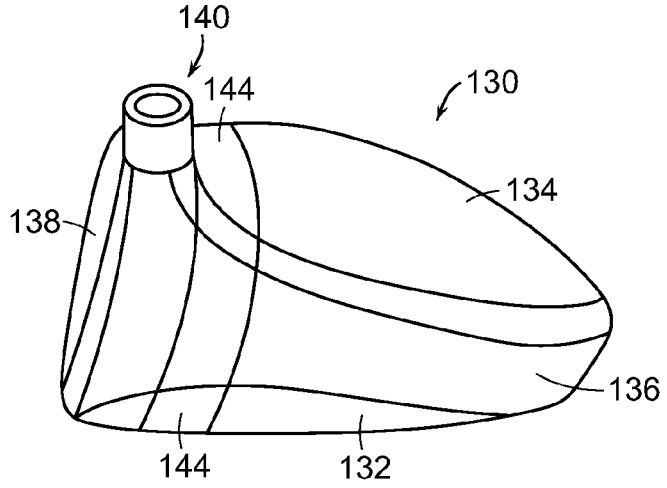
FIG. 11 is a side view of another embodiment of a golf club head of the present invention.
Figure 13:
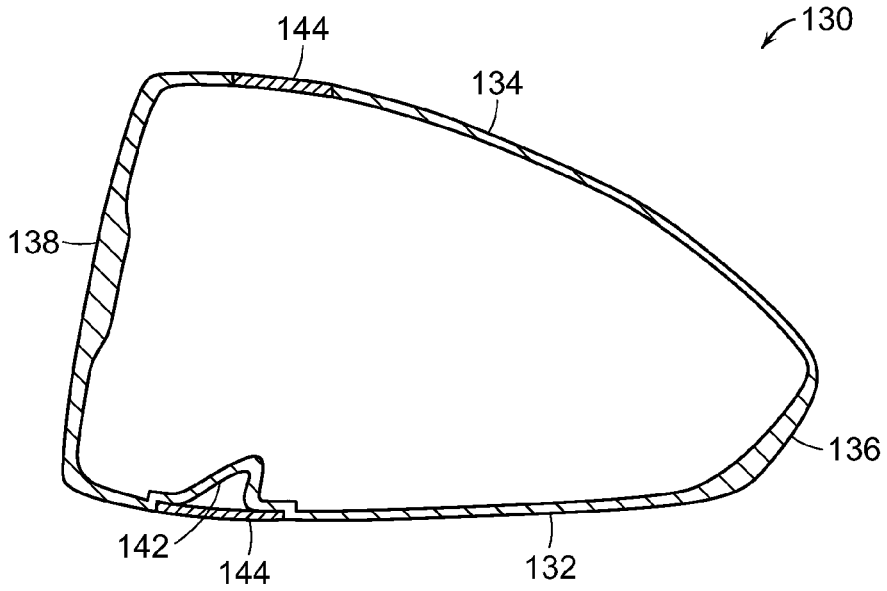
FIG. 13 is a cross-sectional view, corresponding to line 13-13 of FIG. 12.

In additional embodiments, a compliant flexure may be combined with a multi-material, light density cover member, as shown in FIGS. 11-13. For example, golf club head 130 generally has a hollow body construction that is defined by a sole 132, a crown 134, a skirt 136, a face 138 and a hosel 140.

Golf club head 130 also includes a flexure 142 that is formed in a forward portion of sole 132 of golf club head 130. A cover 144 is also included in golf club head 130 and is configured to cover the outer surface of the flexure.

Cover 144 is generally a strip of material that is disposed across flexure 142 to generally enclose flexure 142. Cover 144 may be dimensioned so that it covers a portion or all of flexure 142, and it may extend into portions of golf club head 130 that do not include flexure. For example, and as shown in FIGS. 11 and 12, cover 144 extends across, and covers flexure 142 that is disposed on sole 132. Further, cover 144 forms a portion of skirt 136 and crown 134. Preferably, cover 144 is constructed of a material that is different than the materials of sole 132, crown 134 and skirt 136. Cover 144 is coupled to the adjacent portions of golf club head 130 by welding, brazing or adhering to those adjacent portions.

The cover may be included to both assist in the control of the address position of the golf club head when the sole is placed on the playing surface and to eliminate undesirable aesthetics of the flexure. In particular, the cover may be included to tune the visual face angle of the golf club head when the head is placed on the playing surface by altering the contact surface of the golf club head. The cover may be configured to wrap around a perimeter of the golf club head to the crown and may replace a portion of the material of the perimeter to create a lower density body structure to provide additional discretionary mass, a lower and/or deeper center of gravity location and a higher moment of inertia, thus improving performance and distance potential.

Figure 14:
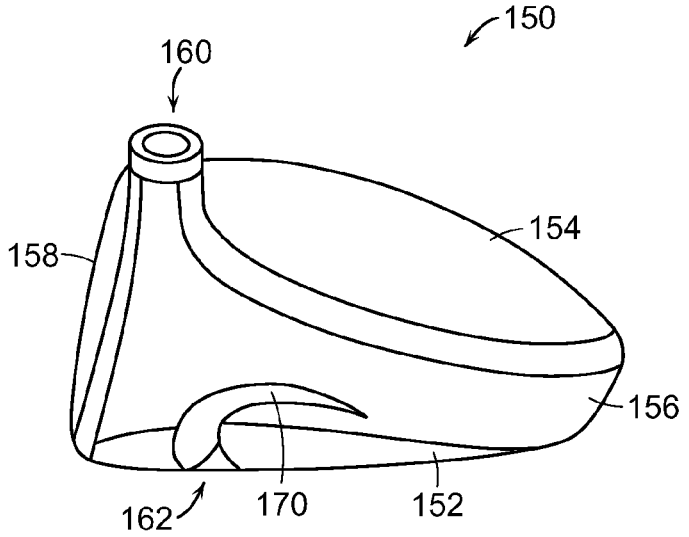
FIG. 14 is a side view of another embodiment of a golf club head of the present invention.
Figure 15:
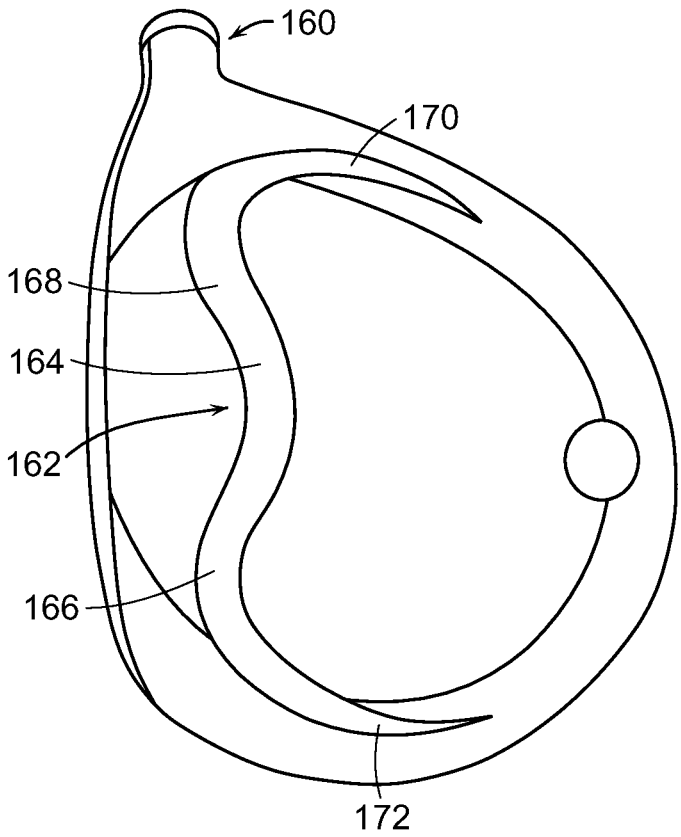
FIG. 15 is a bottom plan view of the golf club head of FIG. 14.

Referring now to FIGS. 14 and 15, a golf club head 150 including a flexure 162 having a varied spatial relationship to the face plane along its heel to toe length will be described. Due to the geometry of a golf club head face coupled with the circular shape of the stress imparted to the face during ball impact, the lower portion of the face generally experiences different magnitudes of stress at different heel-to-toe locations. Generally the portions of the golf club head at the heel and toe ends experience lower stresses than the portion of the golf club directly below the geometric center of the face and that stress gradient translates to the stress on the sole in the region of flexure 162. The distance of the flexure relative to the face plane and/or the leading edge of the face/sole intersection is altered to correspond to the relative amount of stress at the various portions. For example, the heel and toe portions of the flexure are preferably located closer to the face plane and leading edge of the golf club head so that those portions will be more likely to experience flexing even under the lower stress conditions, and especially during off-center ball impacts.

Golf club head 150 has a hollow body construction that is defined by a sole 152, a crown 154, a skirt 156, a face 158 and a hosel 160. Flexure 162 is formed in a forward portion of the golf club head and extends generally across the golf club head in a heel to toe direction through the sole and skirt. Flexure 162 generally includes a central portion 164, a toe portion 166 and a heel portion 168. As described above, the portions of flexure 162 are disposed at varied spatial relationships relative to the face plane so that central portion 164 is further aftward from the face plane compared to toe portion 166 and heel portion 168. Further, flexure 162 includes heel and toe extensions 170, 172 that extend from the heel and toe portions 168, 166, respectively along skirt 156 aftward. Heel and toe extensions 170, 172 may also extend aftward and meet at a location on the skirt or sole.

As described above, the flexure of the present invention provides lower stiffness locally in a portion of the golf club head. Generally the lower stiffness may be achieved by selecting the geometry of the flexure, such as by altering the shape and/or cross-sectional thickness, and/or by selecting the material of portions of the flexure. Materials that may be selected to provide the lower stiffness flexure include low Young's modulus beta (β), or near beta (near-β), titanium alloys.

Beta titanium alloys are preferable because they provide a material with relatively low Young's modulus. The deflection of a plate supported at its perimeter under an applied stress is a function of the stiffness of the plate. The stiffness of the plate is directly proportional to the Young's modulus and the cube of the thickness (i.e., $t^3$). Therefore, when comparing two material samples that have the same thickness and differing Young's moduli, the material having the lower Young's modulus will deflect more under the same applied force. The energy stored in the plate is directly proportional to the deflection of the plate as long as the material is behaving elastically and that stored energy is released as soon as the applied stress is removed. Thus, it is desirable to use materials that are able to deflect more and consequently store more elastic energy.

Additionally, it is preferable to match the frequency of vibration of a golf club face with the frequency of vibration of a golf ball to maximize the golf ball speed off the face after an impact. The frequency of vibration of the face depends on the face parameters, such as the material's Young's modulus and Poisson's ratio, and the face geometry. The alpha-beta (α-β) Ti alloys typically have a modulus in the range of 105-120 GPa. In contrast, current β-Ti alloys have a Young's modulus in the range of 48-100 GPa.

The material selection for a golf club head must also account for the durability of the golf club head through many impacts with golf balls. As a result, the fatigue life of the face must be considered, and the fatigue life is dependent on the strength of the selected material. Therefore, materials for the golf club head must be selected that provide the maximum ball speed from a face impact and adequate strength to provide an acceptable fatigue life.

The β-Ti alloys generally provide low Young's modulus, but are also usually accompanied by low material strength. The β-Ti alloys can generally be heat treated to achieve increases in strength, but the heat treatment also generally causes an increase in Young's modulus. However, β-ti alloys can be cold worked to increase the strength without significantly increasing the Young's modulus, and because the alloys generally have a body centered cubic crystal structure they can generally be cold worked extensively.

Preferably, a material having strength in a range of about 900-1200 MPa and a Young's modulus in a range of about 48-100 GPa is utilized for portions of the golf club head. For example, it would be preferably to use such a material for the face and/or flexure and/or flexure cover of the golf club head. Materials exhibiting characteristics in those ranges include titanium alloys that have generally been referred to as Gum Metals.

Although less preferable, heat treatment may be used on β-Ti to achieve an acceptable balance of strength and Young's modulus in the material. Previous applications of β-titanium alloys generally required heat treating to maximize the strength of the material without controlling Young's modulus. Titanium alloys go through a phase transition from hexagonal close packed crystal structure α phase to a body centered cubic β phase when heated. The temperature at which this transformation occurs is called the β-transus temperature. Alloying elements added to titanium generally show either a preference to stabilize the α phase or the β phase, and are therefore referred to as α stabilizers or β stabilizers. It is possible to stabilize the β phase even at room temperature by alloying titanium with a certain amount of β stabilizers. However, if such an alloy is re-heated to elevated temperature, below the β-transus temperature, the β phase decomposes and transforms into α phase as dictated by the thermodynamic rules. Those alloys are referred to as metastable β titanium alloys.

While the thermodynamic laws only predict the formation of α phase, in reality a number of non-equilibrium phases appear on the decomposition of the β phase. These non-equilibrium phases are denoted by α', α", and ω. It has been reported that each of these phases has different Young's moduli and that the magnitude of the Young's modulus generally conforms with β<α"<α<ω. Thus, it is speculated that if one desires to increase the strength of β-titanium through heat treatment, it would be advantageous to do it in such a manner that the material includes α" phase as a preferred decomposition product and we eliminate, or minimize the formation of α and ω phases. The formation of α" phase is facilitated by quenching from the α+β region on the material phase diagram, which means the alloy should be quenched from below the β-transus temperature. Therefore, preferably a β-Ti alloy that has been heat treated to maximize the formation of α" phase from the β phase is used for a portion of the golf club head.

The heat treatment process is selected to provide the desired phase transformation. Heat treatment variables such as maximum temperature, time of hold, heating rate, quench rate are selected to create the desired material composition. Further, the heat treatment process may be specific to the alloy selected, because the effect of different β stabilizing elements is not the same. For example, a Ti—Mo alloy would behave differently than Ti—Nb alloy, or a Ti—V alloy, or a Ti—Cr alloy; Mo, Nb, V and Cr are all β stabilizers but have an effect of varying degree. The β-transus temperature range for metastable β-Ti alloys is about 700° C. to about 800° C. Therefore, for such alloys the solution treating temperature range would be about 25-50 Celsius degrees below the β-transus temperature, in practical terms the alloys would be solution treated in the range of about 650° C. to about 750° C. Following water quenching, it is possible to age the β-Ti alloys at low temperature to further increase strength. Strength of the solution treated material was measured to be about 650 MPa, while the heat treated alloy had a strength of 1050 MPa.

Examples of suitable beta titanium alloys include: Ti-15Mo-3Al, Ti-15Mo-3Nb-0.3O, Ti-15Mo-5Zr-3Al, Ti-13Mo-7Zr-3Fe, Ti-13Mo, Ti-12Mo-6Zr-2Fe, Ti—Mo, Ti-35Nb-5Ta-7Zr, Ti-34Nb-9Zr-8Ta, Ti-29Nb-13Zr2Cr, Ti-29Nb-15Zr-1.5Fe, Ti-29Nb-10Zr-0.5Si, Ti-29Nb-10Zr-0.5Fe-0.5Cr, Ti-29Nb-18Zr—Cr-0.5Si, Ti-29Nb-13Ta-4.6Zr, Ti—Nb, Ti-22V-4Al, Ti-15V-6Cr-4Al, Ti-15V-3Cr-3Al-3Sn, Ti-13V-11Cr, Ti-10V-2Fe-3Al, Ti-5Al-5V-5Mo-3Cr, Ti-3Al-8V-6Cr-4Mo-4-Zr, Ti-1.5Al-5.5Fe-6.8Mo, Ti-13Cr-1Fe-3Al, Ti-6.3Cr-5.5Mo-4.0Al-0.2Si, Ti—Cr, Ti—Ta alloys, the Gum Metal family of alloys represented by Ti+25 mol % (Ta, Nb, V)+(Zr, Hf, O), for example, Ti-36Nb-2Ta-3Zr-0.35O, etc (by weight percent). Near beta titanium alloys may include: SP-700, TIMET 18, etc.

In general, it is preferred that a face cup or face insert of the inventive golf club head be constructed from α–β or near-β titanium alloys due to their high strength, such as Ti-64, Ti-17, ATI425, TIMET 54, Ti-9, TIMET 639, VL-Ti, KS ELF, SP-700, etc. Further the rear portion of the golf club body, i.e., the portion other than the face cup, face insert, flexure and flexure cover, is preferably made from α, α–β, or β titanium alloys, such as Ti-8Al-1V-1Mo, Ti-8Al-1Fe, Ti-5Al-1Sn-1Zr-1V-0.8Mo, Ti-3Al-2.5Sn, Ti-3Al-2V, etc.

Various manufacturing methods may be used to construct the various components of the golf club head of the present invention. Preferably all of the components are joined by welding. The welding processes may be manual, such as TIG or MIG welding, or they may be automated, such as laser, plasma, e-beam, ion beam, or combinations thereof. Other joining processes may also be utilized if desired or required due to the material selections, such as brazing and adhesive bonding.

The components may be created using stamping and forming processes, casting processes, molding processes and/or forging processes. The following are examples of material selections for the portions of the golf club head utilizing stamping and forming processes:

a) α–β face member+β flexure+α–β rear body
b) β face member+α–β face insert+β flexure+α–β rear body
c) β face member+α–β face insert+β flexure+β rear body
d) β face member+α–β face insert+β flexure+α–β rear body (Heat Treated)

The following are examples of material selections for the portions of the golf club head utilizing cast components:

a) Cast α–β face member+Cast β flexure+Cast α–β rear body
b) Formed α–β face member+Cast β flexure+Cast α–β rear body
c) Formed α–β face member+Cast β flexure+Formed α–β rear body
d) Cast α–β face member+Cast β flexure+Formed α–β rear body The following are examples of material selections for the portions of the golf club head utilizing forged components:

a) Forged α–β face member+Cast β flexure+Cast α–β rear body
b) Forged α–β face member+Cast β flexure+Formed α–β rear body The density of β alloys is generally greater than the density of α–β or α alloys. As a result, the use of β alloys in various portions of the golf club head will result in those portions having a greater mass. Light weight alloys may be used in the rear portion of the body so that the overall golf club head mass may be maintained in a desired range, such as between about 170 g and 210 g for driver-type golf club heads. Materials such as aluminum alloys, magnesium alloys, carbon fiber composites, carbon nano-tube composites, glass fiber composites, reinforced plastics and combinations of those materials may be utilized.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. For example, the face insert may have thickness variations in a step-wise continuous fashion. In addition, the shapes and locations of the slots are not limited to those disclosed herein. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A golf club head, the club head comprising:

a crown defining an upper surface of the golf club head;

a sole defining a lower surface of the golf club head;

a side wall extending between the crown and sole;

a hosel extending from the crown and including a shaft bore;

a face defining a ball-striking surface and intersecting the lower surface at a leading edge; and an elongate flexure that is recessed into the sole, extending in a generally heel-to-toe direction, and intersecting the side wall of the golf club head, wherein the flexure is defined by a curved first portion and a second portion that join at an apex, wherein the flexure has a height, a width and a curl length, wherein the height extends in the direction of a Y-axis of the golf club head between the apex and an outer surface of the sole, wherein the width extends in the direction of a Z-axis of the golf club head and is a distance of the opening in the sole of the flexure, wherein the curl length extends in the direction of the Z-axis and extends between a forward junction of the flexure with the sole and the apex, wherein the height of the flexure is between about 5.0 mm and 15.0 mm, wherein the width of the flexure is between about 7.0 mm and about 11.0 mm, wherein a wall thickness of the flexure is between about 0.8 mm and about 2.0 mm over a length of the flexure that is at least 25% of the overall club head length along the X-axis of the golf club head, wherein the X-axis extends horizontally in a heel to toe direction, and wherein the first portion extends inward from the lower surface of the golf club head, and the second portion extends between an aft end of the first portion and the sole generally perpendicularly the sole.

2. The golf club head of claim 1, wherein the flexure has a height of about 6.0 mm to about 11.0 mm.

3. A golf club head, the club head comprising:

a crown defining an upper surface of the golf club head;

a sole defining a lower surface of the golf club head;

a side wall extending between the crown and sole;

a hosel extending from the crown and including a shaft bore;

a face defining a ball-striking surface and intersecting the lower surface at a leading edge; and an elongate flexure that is recessed into the sole, extending in a generally heel-to-toe direction, and intersecting the side wall of the golf club head, wherein the flexure is defined by a curved first portion and a second portion that join at an apex, wherein the flexure has a height, a width and a curl length, wherein the height extends in the direction of a Y-axis of the golf club head between the apex and an outer surface of the sole, wherein the width extends in the direction of a Z-axis of the golf club head and is a distance of the opening in the sole of the flexure, wherein the curl length extends in the direction of the Z-axis and extends between a forward junction of the flexure with the sole and the apex, wherein the height of the flexure is between about 5.0 mm and 15.0 mm, wherein the width of the flexure is between about 7.0 mm and about 11.0 mm, wherein a wall thickness of the flexure is between about 0.8 mm and about 2.0 mm over a length of the flexure that is at least 25% of the overall club head length along the X-axis of the golf club head, wherein the X-axis extends horizontally in a heel to toe direction, and wherein the flexure is tuned so that the width across the flexure in a face-to-aft direction varies sinusoidally, immediately after impact, at a frequency of about 2900 Hz to about 4000 Hz.

4. The golf club head of claim 3, wherein the flexure extends to the crown of the golf club head.

5. The golf club head of claim 3, wherein the flexure has a height of about 6.0 mm to about 11.0 mm.

6. The golf club head of claim 3, wherein the first portion is curved with a radius of curvature of about 20 mm to about 45 mm.

7. The golf club head of claim 3, wherein at least a portion of the flexure is constructed of a β-Ti alloy.

8. The golf club head of claim 3, wherein portions of the flexure are disposed at varied spatial relationships relative to a face plane of the golf club head.

9. The golf club head of claim 8, wherein a central portion of the flexure is disposed further aftward from the face plane compared to a toe portion.

10. The golf club head of claim 8, wherein a central portion of the flexure is disposed further aftward from the face plane compared to a heel portion.

11. The golf club head of claim 3, wherein the flexure includes heel and toe extensions that extend from the heel and toe portions, respectively, along the skirt and aftward.

12. A golf club head, the club head comprising:

a crown defining an upper surface of the golf club head;

a sole defining a lower surface of the golf club head;

a side wall extending between the crown and sole;

a hosel extending from the crown and including a shaft bore;

a face defining a ball-striking surface and intersecting the lower surface at a leading edge; and a flexure component defining an elongate flexure, wherein the flexure component is coupled to the sole so that the elongate flexure is recessed into the sole and defined by a first member and a second member, wherein the length of the first member is different than the length of the second member, wherein the first member extends from the sole toward the interior of the golf club head and the second member extends from the sole toward the interior of the golf club head, wherein the first member interfaces the second member at an apex, wherein the flexure has a height, a width and a curl length, wherein the height extends in the direction of a Y-axis of the golf club head between the apex and an outer surface of the sole, wherein the width extends in the direction of a Z-axis of the golf club head and is a distance of the opening in the sole of flexure, wherein the curl length extends in the direction of the Z-axis and extends between a forward junction of the flexure with the sole and the apex along a curvature of the first member, wherein the flexure has a width of about 7.0 mm to about 11.0 mm, and wherein the elongate flexure extends to the side wall of the golf club head.

13. The golf club head of claim 12, wherein the first member has a wall thickness of about 0.9 mm to about 2.0 mm.

14. The golf club head of claim 12, wherein the flexure has a height of about 6.0 mm to about 11.0 mm.

15. The golf club head of claim 12, wherein the flexure is machined with a tool having an axis of rotation that is generally parallel to the sole and perpendicular to the leading edge.

16. The golf club head of claim 12, wherein at least a portion of the flexure is constructed of a β-Ti alloy.

17. The golf club head of claim 12, wherein the flexure extends across the body in a generally heel-to-toe direction within about 5.0 mm and about 20.0 mm from the leading edge of the golf club head.

18. The golf club head of claim 12, wherein the flexure further comprises a third member that is coupled to a surface of the flexure, wherein the third member is constructed from a material that has a lower specific gravity than a material of at least one of the first member and the second member.

19. The golf club head of claim 18, wherein the third member is coupled to an inner surface of the flexure.

20. The golf club head of claim 18, wherein the third member is coupled to an outer surface of the flexure.

* * * * *